United States Patent [19]

Motoda

[11] 3,940,110

[45] Feb. 24, 1976

[54] LIFTING APPARATUS

[76] Inventor: Kenro Motoda, 9-32-4, Kami-Kitazawa, Setagaya, Tokyo, Japan

[22] Filed: Oct. 7, 1974

[21] Appl. No.: 512,887

Related U.S. Application Data

[63] Continuation-in-part of Ser. No. 460,473, April 12, 1974, abandoned, which is a continuation of Ser. No. 356,063, May 1, 1973, abandoned.

[52] U.S. Cl. ..... 254/168; 212/1; 212/39 MS; 323/22 Z

[51] Int. Cl.[2] ..... B66D 1/00

[58] Field of Search ..... 254/168, 173 R, 173 B; 323/8, 22 Z; 317/148.5 B, 33 UR; 307/317 R, 318, 237; 212/1, 39 MS, 8 R; 318/626; 244/77 M; 114/144 R

[56] References Cited

UNITED STATES PATENTS

| | | | |
|---|---|---|---|
| 3,129,686 | 4/1964 | Sakson | 114/144 R |
| 3,199,685 | 8/1965 | Bopp | 212/39 MS |
| 3,426,263 | 2/1969 | Hennigan et al. | 323/8 |
| 3,838,656 | 10/1974 | Greene | 114/114 R |

*Primary Examiner*—Robert J. Spar
*Assistant Examiner*—Lawrence J. Oresky
*Attorney, Agent, or Firm*—Wenderoth, Lind & Ponack

[57] ABSTRACT

A lifting apparatus provided with a weight limit setting device which sets a limit to the weight of a load so that the lifting apparatus can safely lift a load. The device comprises a spring member the top end of which moves vertically in response to the weight of a load, a potentiometer for producing an output signal in proportion to the vertical movement of the spring member, and a comparator for comparing the output signal with a reference signal, whereby no load heavier than the limit thus set is lifted even if the lifting apparatus is operated to lift the load.

1 Claim, 6 Drawing Figures

FIG. 1
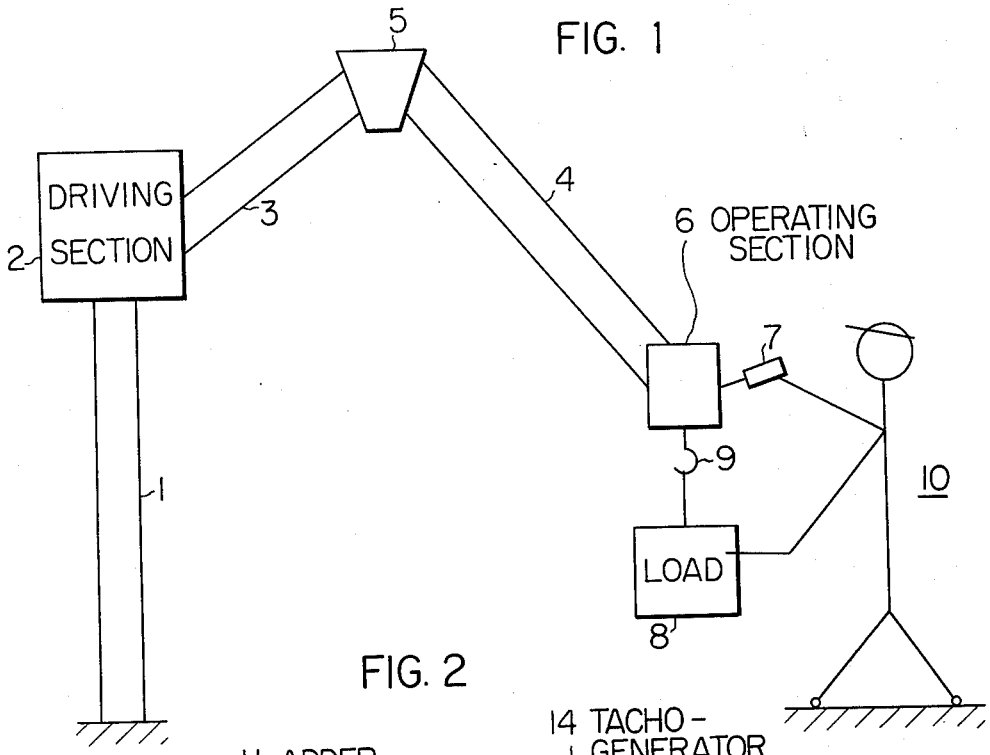
FIG. 2
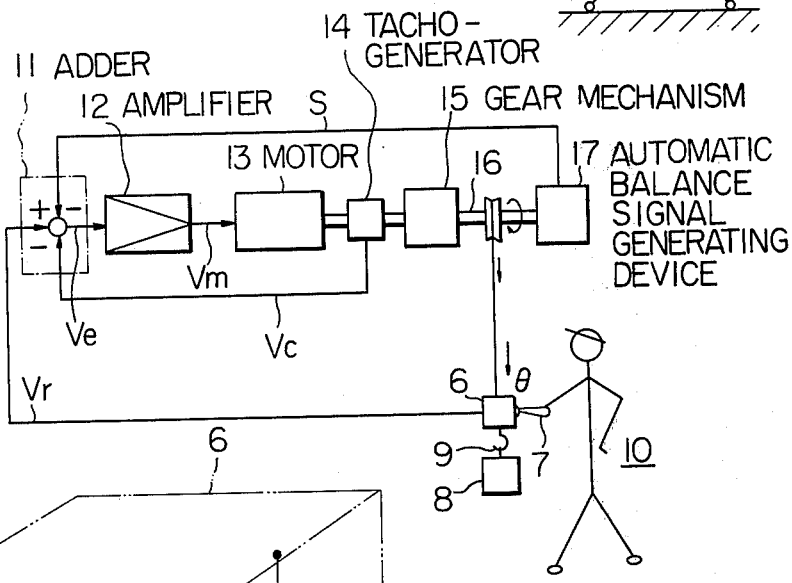
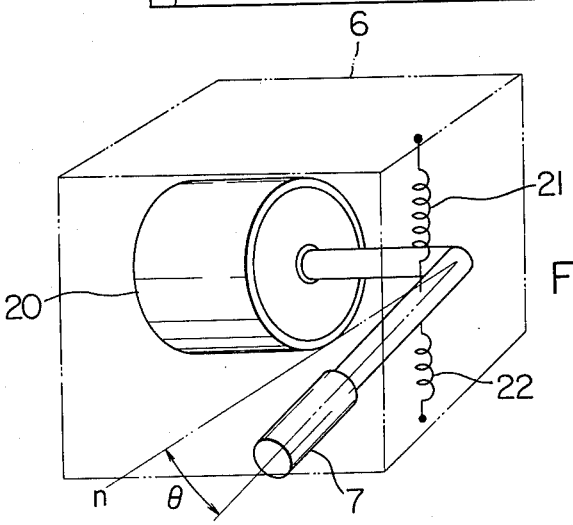
FIG. 3

LIFTING APPARATUS

CROSS REFERENCE TO RELATED APPLICATIONS

This application is a continuation-in-part of application Ser. No. 460,473, filed on Apr. 12, 1974, now abandoned, which is a continuation of application Ser. No. 356,063, filed on May 1, 1973, now abandoned.

BACKGROUND OF THE INVENTION

This invention relates to lifting apparatuses.

The weight limit of a load which a lifting apparatus can safely move up and down is determined by the mechanical structure of the lifting apparatus. Accordingly, heretofore it has been inevitable that the weight limit is obtained in advance so that only the loads whose weights are lighter than the weight limit thus determined are lifted by the lifting apparatus. That is, the conventional lifting apparatus is disadvantageous in that it takes time and labor to weigh loads which are to be lifted by the conventional lifting apparatus. If a load which is heavier than the weight limit is lifted by the lifting apparatus by mistake, it will cause a dangerous accident and shorten the service life of the lifting apparatus.

Furthermore, it has been strongly demanded in the art to provide a device which can be employed in various lifting apparatuses by readily changing the weight limit according to the allowable weights thereof.

SUMMARY OF THE INVENTION

Accordingly, it is an object of this invention to provide a lifting apparatus in which a load heavier than a weight limit set for the lifting apparatus is not lifted even if a control lever is operated to lift the load, the load is automatically balanced by leaving an operator's hand off the control lever, and the load is moved downward by moving the control lever downward.

Another object of the invention is to provide a lifting apparatus in which the weight limit of a load to be moved can be readily changed.

A further object of the invention is to provide a lifting apparatus which is remarkably improved in both safe operation and service life.

A still further object of the invention is to provide a lifting apparatus which can be positively and safely operated with the aid of a simple control circuit.

The manner in which the foregoing objects and other objects are achieved by this invention will become more apparent from the following detailed description and the appended claims when read in conjunction with accompanying drawings, in which like parts are designated by like reference numerals or characters.

BRIEF DESCRIPTION OF THE DRAWINGS

In the accompanying drawings:

FIG. 1 is a schematic diagram illustrating a lifting apparatus to which this invention can be applied;

FIG. 2 is a block diagram illustrating the control system of the lifting apparatus shown in FIG. 1;

FIG. 3 is a perspective view of an operating section of the lifting apparatus shown in FIG. 1;

DETAILED DESCRIPTION OF THE INVENTION

Figure 4:
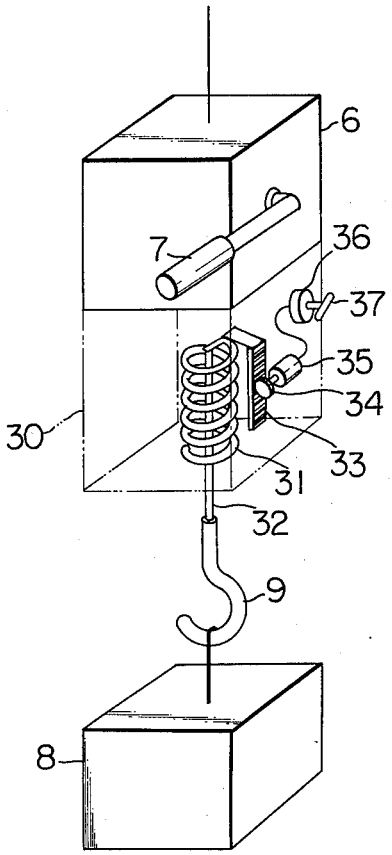
FIG. 4 is a perspective view illustrating a weight limit setting device, according to this invention, employed in the lifting device shown in FIG. 1.

As conducive to a full understanding of this invention, first a lifting apparatus to which this invention can be applied will be described with reference to FIG. 1.

The lifting apparatus comprises: a support 1; a driving section 2 which is provided on the support 1, for driving the apparatus; arms 3 and 4 connected to the driving section 2 through an arm connecting member 5 which is adapted to connect these arms 3 and 4 to each other; an operating section 6, which is provided at the end of the arm 4; and a load carrying section, or load carrying member 9 which is adapted to hang a load 8 which is to be moved to a desired place. The operating section 6 has a control lever 7 which is operated by an operator 10.

A control system of this lifting apparatus is shown in FIG. 2, and a structure of the operating section 6 is illustrated in FIG. 3.

The control system shown in FIG. 2 includes: a servo system provided in the driving section 2, and an automatic balance signal generating section 17. The servo system comprises an adder 11 which carries out addition and subtraction operations of a target speed signal $Vr$, an automatic balance signal S and a speed feedback signal $Vc$ to apply a driving signal $Ve$ to an amplifier 12; an electric motor 13 which is driven with the aid of a driving signal $Vm$ obtained by amplifying the driving signal $Ve$ by the amplifier 12; a tacho-generator 14 which is connected to the rotary shaft of the motor 13 to produce the speed feedback signal $Vc$ proportional to the rate of rotation of the rotary shaft; and a reduction gear mechanism 15. The automatic balance signal generating device 17 is connected to an output shaft of the apparatus, that is shaft 16 of the gear mechanism 15. When the vertical movement of the load is stopped, the device 17 produces the automatic balance signal S which is employed to maintain the load wherever it is stopped.

The operating section 6, as is shown in FIG. 3, comprises a potentiometer 20 for providing the target speed signal $Vr$ corresponding to the vertical displacement (angle $\theta$ of rotation) of the control lever 7 from the neutral position $n$ of the control lever 7, and a pair of springs 21 and 22 to keep the control lever at the neutral position $n$. One end of the upper spring 21 is connected to the control lever 7, while the other end is connected to the upper wall of the operating section 6. Similarly, one end of the lower spring 22 is connected to the control lever, while the other end is connected to the lower wall of the operating section 6.

With the lifting apparatus thus organized, the operator 10 hangs a heavy load 8 on the load carrying section 9 and moves the load vertically to a desired place by operating the control lever 7.

When the control lever 7 is not operated, the control lever 7 is set at the neutral position $n$ by the mutual action of the upper and lower springs 21, and accordingly no target speed signal $Vr$ for driving the motor 13 is produced by the potentiometer 20, that is, the target speed is zero. In this case, the automatic balance signal S corresponding to the weight of the load 8 is produced by the automatic balance signal generating device 17, whereby the position of the load 8 is maintained unchanged, that is, the load is not moved downward.

When the end of the control lever 7 is depressed downward for instance, the control lever 7 is turned around the axis of rotation of the potentiometer. As a result, the target speed signal V*r* is produced by the potentiometer 20 to drive the motor 13 provided in the driving section 2 (FIG. 1). The rotation of the motor thus driven is transmitted through the gear mechanism 15 to the output shaft 16, whereby the arms 3 and 4 are moved. In this operation, the target speed signal V*r* operates to drive the motor 13 so that the operating section 6 is moved downward, that is, the load 8 is moved downward.

The downward movement speed, in this case, is proportional to the rotational angle $\theta$ of the control lever 7. Accordingly, if the control lever is operated to decrease the angle $\theta$ as the load 8 is moved downward, the downward movement speed of the load is decreased with the decrement of the angle $\theta$. Finally, when the displacement angle $\theta$ becomes zero, that is, the control lever is at the neutral position *n*, the downward movement of the load is stopped, whereupon the load 8 is automatically balanced by the automatic balance signal generating device 17.

The automatic balance signal generating device 17 detects a movement of the load which is caused when the balance is changed by the weight of the load, and converts the movement thus detected into, for instance, a voltage variation which is fed back, as the automatic balance signal S, to the amplifier 12 (adder 11). In this operation, if the balance signal S is increased and decreased respectively by the downward and upward movements of the load 8, the balance signal S corresponding to the variation of weight of the load is produced to achieve the automatic balance operation.

In the case when the operator 10 moves the load upward or downward by operating the control lever 7, it is unnecessary to produce the automatic balance signal S. However, it is necessary that the automatic balance signals S be produced with respect to all of the positions of the operating section 6 ranging from the uppermost position to the lowermost position.

On the other hand, when the control lever 7 is moved upward, a target speed signal V*r* corresponding to the angle $\theta$ is produced to move the load 8 upward. Similarly as in the case when the control lever 7 was moved downward, the upward movement of the load is stopped by operating the control lever in such a manner that the angle $\theta$ becomes zero, that is, the automatic balance of the load is obtained.

When the operator 10 leaves his hand off the control lever 7, the control lever 7 is set at the neutral position *n* by the mutual action of the springs 21 and 22 and the lifting apparatus is under the automatic balance condition.

A weight limit setting device 30 is added, according to this invention, to the operating section 6 of the lifting apparatus thus organized, as is shown in FIG. 4. This weight limit setting device 30 comprises: a spring member 31 whose upper end is connected to the end part 32 of the load hanging member 9, the upper end of the spring member moving vertically in proportion to the weight of a load 8; movement connecting means; a rack 33 which is fixedly connected to the upper end of the spring member 31 and is moved up and down together with the movement, or expansion and contraction, of the spring member 31, and a pinion 34 which is rotated by the vertical movement of the rack 33; a potentiometer 35 which produces a voltage corresponding to the rotation of the pinion 34; and a variable resistor 36 with a knob 37 for changing the output voltage of the potentiometer 35.

Figure 5:
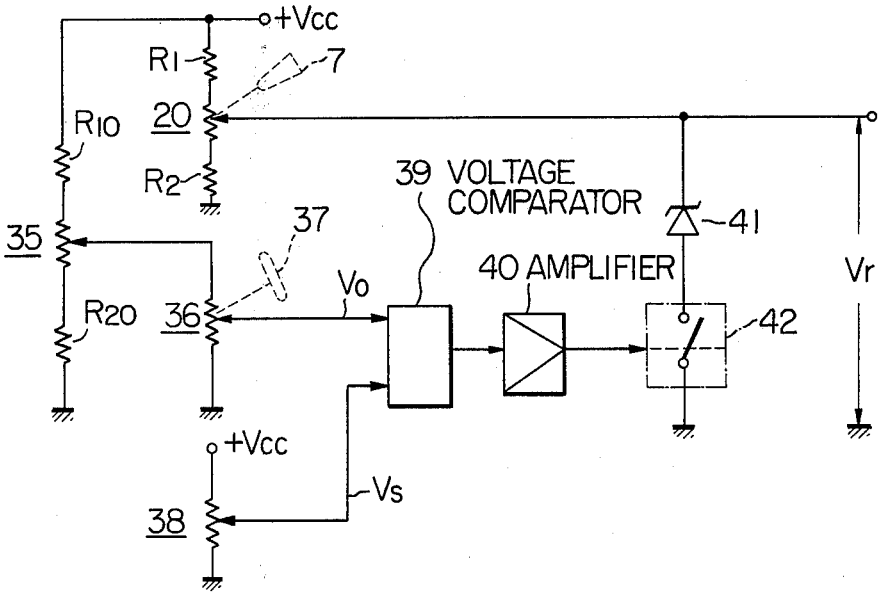
FIG. 5 is a circuit diagram showing one example of a control circuit, according to this invention, employed in the lifting apparatus shown in FIG. 1.

As is indicated in FIG. 5, the output voltage signal V*o* of the variable resistor 36 and a reference voltage signal V*s* provided by a potentiometer 38 are applied to a voltage comparator 39 to produce an output signal to operate an analog switch 42 through an amplifier 40. The analog switch 42 is connected in series to a Zener diode 41 to receive a target speed signal V*r* having a characteristic designated by reference character II in FIG. 6.

Figure 6:
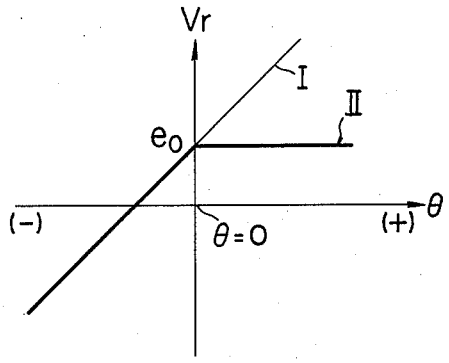
FIG. 6 is a graphical representation indicating characteristics of a target speed signal which controls the operation of the lifting apparatus shown in FIG. 1.

In the graphical representation of FIG. 6, $\theta > 0$, or a positive value of $\theta$, means that the control lever is operated to move the load upward; $\theta < 0$, or a negative value of $\theta$, means that the control lever is operated to move the load downward; and $\theta = 0$ means that the control lever is at the neutral position. Furthermore, a target speed signal V*r* when $\theta = 0$, that is, an output voltage $e_o$ corresponds to a bias voltage which causes the motor to produce the driving power necessary for balancing the load 8.

After the reference signal V*s* has once been set by the potentiometer 38, the reference signal V*s* is maintained unchanged. An output voltage of the potentiometer 35, which forms a series circuit with resistors $R_{10}$ and $R_{20}$, is changed in response to the weight of the load 8 and is gain-controlled by the variable resistor 36. The output voltage thus treated is applied to the voltage comparator 39. This voltage comparator 39 operates to turn off the analog switch 42 when V*o* < V*s* and to turn on the same when V*o* ≧ V*s*, for instance. In this connection, the control circuit shown in FIG. 5 is so designed that the output voltage of the potentiometer 35 is increased with the weight of the load 8. The weight limit can be readily obtained by turning the knob 37 of the potentiometer 36.

When the weight of the load is lighter than the weight limit, that is, the output voltage V*o* of the variable resistor 36 is lower than the reference voltage V*s*, the analog switch 42 is in the "off" state. Accordingly, an output voltage of the potentiometer 20 series-connected through resistors $R_1$ and $R_2$ to a direct current power source is employed as a target speed signal V*r*. That is, a target speed signal V*r* having a character as designated by reference character I in FIG. 6 is obtained, whereby the load is moved upward or downward as was described before.

When the weight of the load 8 is equal to or heavier than the weight limit, that is, the output voltage V*o* of the variable resistor 36 is equal to or higher than the reference voltage V*s*, the analog switch 42 is turned on. Accordingly, the otuput voltage of the potentiometer 20 becomes equal to the Zener voltage ($e_o$) of the Zener diode 36, and thereafter the load is no longer lifted upward even if the control lever 7 is operated to move the load upward.

In other words, when the load is heavier than the weight limit the target speed value V*r* has the characteristic II in FIG. 6. Accordingly, even if the control lever is operated to move the load upward ($\theta > 0$), the target speed signal V*r* is kept equal to the Zener voltage $e_o$ ($Vr = e_o$), that is, the upward movement of the load cannot be effected, whereupon the automatic balance signal generating device starts its operation to obtain the automatic balance of the load, as described above. If, under this condition, the control lever 7 is depressed downward so that the angle $\theta$ becomes negative ($\theta < 0$), the output voltage of the potentiometer 20 becomes lower than the Zener voltage $e_o$ and the load is moved downward.

As is apparent from the description above, no load having a weight heavier than the weight limit is lifted by the lifting apparatus, that is, no load having a weight heavier than the allowable weight which can be safely lifted by the lifting apparatus is moved by the same. As a result, safe operation of the lifting apparatus can be expected, and the service life of the lifting apparatus can be prolonged. Furthermore, the weight limit setting device can be readily installed on the operating section of the lifting apparatus, and the weight limit can be readily changed. Therefore, the weight limit setting device can be installed on a variety of lifting apparatuses.

In addition, the analog switch may be replaced by a magnetic relay with contacts.

What is claimed is:

1. A lifting apparatus for moving a load on a load carrying section by driving a crane-type arm through a driving section with the aid of a target speed signal obtained by operating a control lever provided in an operating section, said lifting apparatus comprising:

a. a servo mechanism means, provided in said driving section, for moving said load carrying section with the aid of said target speed signal;

b. an automatic balance signal generating means, coupled to an output shaft of said servo mechanism means, for supplying an automatic balance signal to said servo mechanism means so that when said control lever is not operated, said load carrying section is maintained stopped;

c. a weight limit setting means operatively coupled to said operating section, for setting a weight limit which said lifting apparatus can safely move, said weight limit setting means comprising a spring member the top end of which moves vertically in proportion to the weight of a load, movement converting means coupled to the top end of said spring member for converting the vertical movement of said spring member into a rotational movement, a first potentiometer operatively connected to said movement converting means for converting the rotational movement into a voltage signal, and a voltage comparator for comparing said voltage signal with a reference voltage signal representative of said weight limit which is supplied thereto by a second potentiometer, thereby producing an output signal; and d. a Zener diode connected through switching means in parallel to an input section of said servo mechanism means, said switching means being operated by said output signal produced by said voltage comparator when said voltage signal from said first potentiometer is equal to or greater than said reference voltage signal from said second potentiometer to maintain said load carrying section stopped, whereby when the weight of said load is equal to or greater than said weight limit, the load is not moved.

* * * * *